US010691036B2

(12) United States Patent
Iwadate

(10) Patent No.: US 10,691,036 B2
(45) Date of Patent: Jun. 23, 2020

(54) IMAGE FORMING APPARATUS AND IMAGE FORMING METHOD IN WHICH DISTANCES BETWEEN IMAGE BEARING MEMBERS AND TRANSFER BELT VARY DEPENDING ON MODE

(71) Applicant: CANON KABUSHIKI KAISHA, Tokyo (JP)

(72) Inventor: Shinnosuke Iwadate, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/292,774

(22) Filed: Mar. 5, 2019

(65) Prior Publication Data

US 2019/0286003 A1 Sep. 19, 2019

(30) Foreign Application Priority Data

Mar. 13, 2018 (JP) ..... 2018-045231

(51) Int. Cl.
*G03G 15/01* (2006.01)
*G03G 15/00* (2006.01)

(52) U.S. Cl.
CPC ..... *G03G 15/0184* (2013.01); *G03G 15/0136* (2013.01); *G03G 15/50* (2013.01); *G03G 15/602* (2013.01); *G03G 2215/0129* (2013.01); *G03G 2215/1614* (2013.01); *G03G 2215/208* (2013.01); *G03G 2215/2074* (2013.01)

(58) Field of Classification Search
CPC ..... G03G 15/0136; G03G 15/0184; G03G 15/0189; G03G 15/205; G03G 15/50; G03G 15/602; G03G 2215/0193; G03G 2215/59
USPC ..... 399/107, 110, 121, 297–302, 308
See application file for complete search history.

(56) References Cited

U.S. PATENT DOCUMENTS

| | | | | |
|---|---|---|---|---|
| 8,620,193 | B2 | 12/2013 | Yamamoto et al. | |
| 8,948,654 | B2 * | 2/2015 | Ju | G03G 15/1615 399/121 |
| 8,989,619 | B2 * | 3/2015 | Karasawa | G03G 21/1671 399/101 |
| 9,176,433 | B2 * | 11/2015 | Okamoto | G03G 15/0189 |
| 9,324,010 | B2 | 4/2016 | Iwadate et al. | |
| 9,541,877 | B2 * | 1/2017 | Eda | G03G 15/553 |
| 10,031,450 | B2 | 7/2018 | Sakaguchi et al. | |

(Continued)

FOREIGN PATENT DOCUMENTS

JP 2005-156776 A 6/2005

*Primary Examiner* — Hoan H Tran
(74) *Attorney, Agent, or Firm* — Venable LLP

(57) ABSTRACT

An image forming apparatus can inhibit an occurrence of downtime or shorten the downtime even in a case in which a mode for performing image formation and a position of, for example, a primary transfer member does not match. The image forming apparatus includes photosensitive drums each configured to bear a toner image, primary transfer members, an intermediate transfer belt, an abutment/separation mechanism configured to move the primary transfer members, and a controller. The controller brings the primary transfer members into contact with the photosensitive drums in a full-color mode, separates the primary transfer members from the photosensitive drums in a monochrome mode, and sets the position of the primary transfer members to a predetermined position between that in the full-color mode and the monochrome mode in a standby mode.

13 Claims, 8 Drawing Sheets

(56) References Cited

U.S. PATENT DOCUMENTS

| | | | |
|---|---|---|---|
| 10,181,095 | B2 | 1/2019 | Takahashi et al. |
| 10,191,424 | B2 | 1/2019 | Shimura et al. |

* cited by examiner

IMAGE FORMING APPARATUS AND IMAGE FORMING METHOD IN WHICH DISTANCES BETWEEN IMAGE BEARING MEMBERS AND TRANSFER BELT VARY DEPENDING ON MODE

BACKGROUND OF THE INVENTION

Field of the Invention

The present disclosure relates to a copying machine and a printer each of which is configured to form a color image on a recording material using an electrophotographic system.

Description of the Related Art

For an electrophotographic image forming apparatus, it has been desired to shorten a first print time required after printing is instructed until outputting is performed and a first copy time required after a copy key is pressed until a copy is output.

In an electrophotographic color image forming apparatus, toner images of respective colors of yellow, magenta, cyan, and black (hereinafter referred to as "Y", "M", "C", and "K") are formed on photosensitive drums of the respective colors, and the images are transferred from the photosensitive drums onto an intermediate transfer belt. There has been widely known a method of superimposing the toner images of the respective colors on each other when the images are transferred onto the intermediate transfer belt, and after that, transferring the images from the intermediate transfer belt onto a sheet or other such transfer material.

In the color image forming apparatus, a specific photosensitive drum may not be used depending on a mode of color to be used. For example, in a monochrome mode for forming a monochrome image, the photosensitive drums of the respective colors of Y, M, and C are not used, and only the photosensitive drum of K is used. Meanwhile, in a full-color mode, all the photosensitive drums of Y, M, C, and K are used.

In Japanese Patent Application Laid-Open No. 2005-156776, there is proposed a configuration in which, in the monochrome mode, primary transfer rollers of the respective colors of Y, M, and C are moved so as to separate the photosensitive drums and the intermediate transfer belt from each other. By separating the photosensitive drums and the primary transfer rollers from each other so as to prevent the intermediate transfer belt from being brought into contact with the photosensitive drum, the photosensitive drums of the respective colors of Y, M, and C are inhibited from being used, to thereby produce an advantage that life of an intermediate transfer belt, the photosensitive drums of the respective colors of Y, M, and C, and other such member is extended.

In the technology described in Japanese Patent Application Laid-Open No. 2005-156776, it is required to switch a separated position of the primary transfer roller between a time of color image formation (full-color mode) and a time of monochrome image formation (monochrome mode) when the toner image is transferred onto the intermediate transfer belt. The separated position of the primary transfer roller refers to a position of the primary transfer roller in a state in which at least one primary transfer roller is separated from the photosensitive drum.

In this case, before starting the image formation on the photosensitive drum, it is required to match the position of the primary transfer roller and the mode for performing the image formation. That is, in the respective colors of Y, M, and C, it is required to bring the respective photosensitive drums and the intermediate transfer belt into a contact state in the full-color mode, and bring those components into a separated state in the monochrome mode.

When the mode of color to be used for performing the image formation and the position of the primary transfer roller do not match, an operation for the abutment and an operation for the separation are required, which causes downtime.

Therefore, it is desired to prevent an occurrence of such downtime or shorten the downtime even when the mode for performing the image formation and the position of, for example, the primary transfer roller do not match.

SUMMARY OF THE INVENTION

An image forming apparatus according to the present disclosure has an image forming mode in which an image is formed and a standby mode in which an image is not formed as states of the image forming apparatus, and has a color mode for forming a color image and a monochrome mode for forming a monochrome image as modes to be employed in a case where an image is formed in the image forming mode, the image forming apparatus includes: a first image bearing member configured to bear a toner image; a second image bearing member configured to bear a toner image; a belt member onto which the toner images borne on the first image bearing member and the second image bearing member are to be transferred; a first transfer member configured to transfer the toner image borne on the first image bearing member onto the belt member; a second transfer member configured to transfer the toner image borne on the second image bearing member onto the belt member; a first moving unit configured to move the first transfer member; and a controller configured to control the first moving unit to move the first transfer member such that: in the monochrome mode, the belt member is located at a first position at which the belt member is separated from the first image bearing member; in the color mode, the belt member is located at a second position at which the belt member is in contact with the first image bearing member; and in the standby mode, the first transfer member is located at a predetermined position between the first position and the second position, wherein the belt member is in contact with the second image bearing member in the image forming mode and the standby mode.

Further features of the present invention will become apparent from the following description of exemplary embodiments (with reference to the attached drawings).

DESCRIPTION OF THE EMBODIMENTS

Now, an embodiment of the present disclosure is described in detail with reference to the accompanying drawings. An image forming apparatus described below has, as states thereof, an image forming mode in which an image is formed and a standby mode in which an image is not formed. The image forming apparatus also has, as modes of color, a color mode for forming a color image and a monochrome mode for forming a monochrome image when an image is formed in the image forming mode. In the following embodiments, as an example of "color mode", full-color mode, in which the colors of yellow, magenta, cyan, and black are used, is described. A position of a primary transfer roller (as primary transfer member) exhibited when the image forming apparatus is in the standby mode in which an image is not formed is referred to as "standby position", and a position of the primary transfer roller exhibited when a monochrome image is formed in the monochrome mode is referred to as "monochrome position". In the same manner, a position of the primary transfer roller exhibited when a color image is formed in the full-color mode is referred to as "fully abutted position". In addition, a position of all the primary transfer rollers that have been separated from photosensitive drums is referred to as "fully separated position".

First Embodiment

<Schematic Configuration of Image Forming Apparatus>

Figure 1:
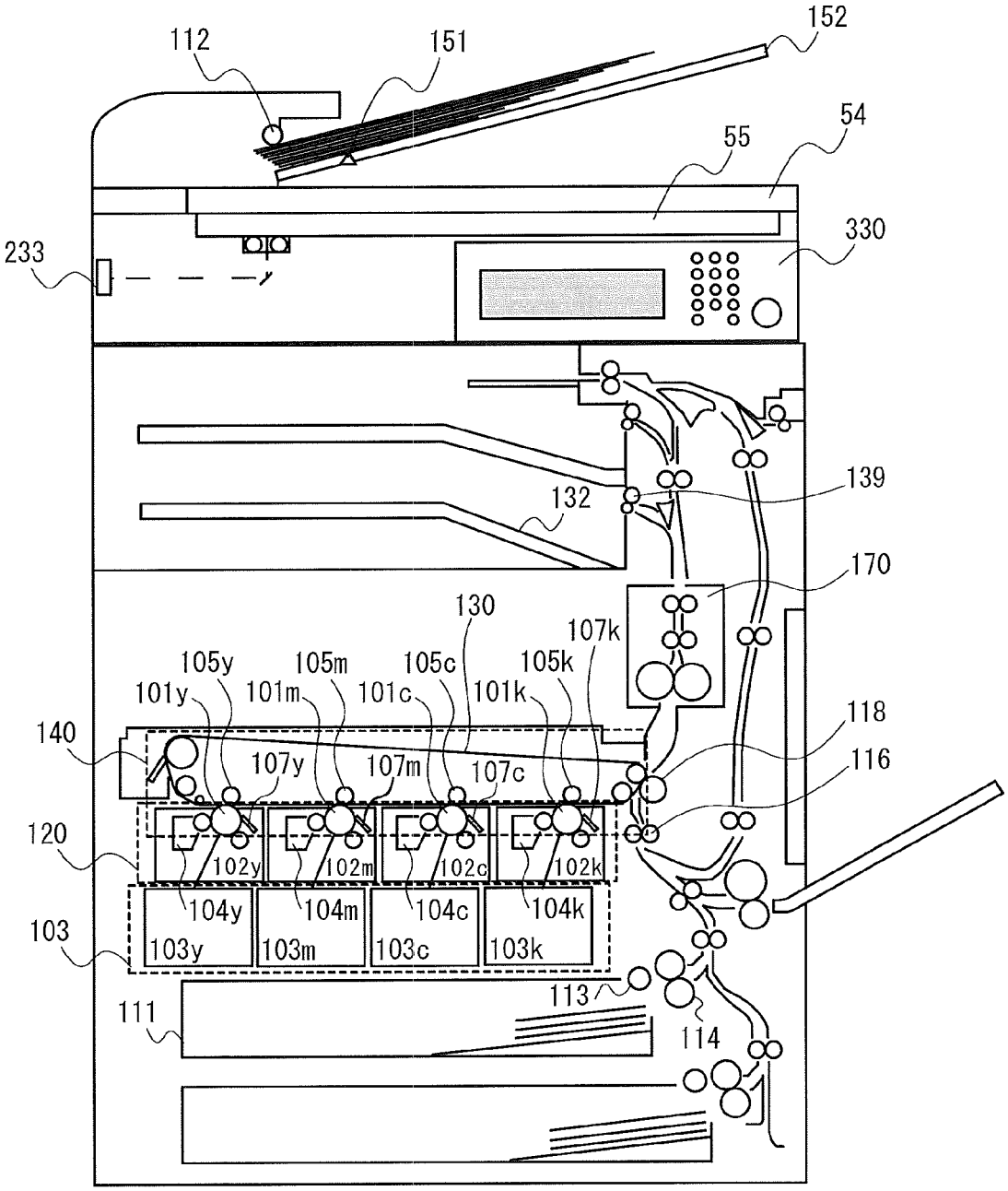
FIG. 1 is a schematic configuration view of an image forming apparatus.

FIG. 1 is a configuration view of an image forming apparatus according to a first embodiment of the present disclosure. The image forming apparatus includes a printer section configured to perform image forming processing, a scanner section configured to read an original image from an original, and a user interface (UI) 330 being an operating section configured to receive an operation performed by a user.

The scanner section includes an original table 152, an original presence-or-absence sensor 151, an original conveying roller 112, a glass table 55, and an image sensor 233. An original is placed on the original table 152. The original presence-or-absence sensor 151 detects the presence or absence of the original on the original table 152. The original conveying roller 112 conveys originals placed on the original table 152 to a reading position one by one. The image sensor 233 optically reads the original conveyed to the reading position to generate an image signal. On the glass table 55, the user directly places an original without using the original table 152. The image sensor 233 can also optically read the original placed on the glass table 55 to generate an image signal.

The printer section includes an image forming unit 120, a laser scanner unit 103, an intermediate transfer unit 140, a secondary transfer roller 118 (as a secondary transfer member), a fixing device 170, and different kinds of rollers configured to convey a sheet on which an image is to be formed.

The image forming unit 120 includes photosensitive drums 101*y*, 101*m*, 101*c*, and 101*k*, which serve as image bearing members, and charge rollers 102*y*, 102*m*, 102*c*, and 102*k*. The image forming unit 120 also includes developing devices 104*y*, 104*m*, 104*c*, and 104*k* and drum cleaners 107*y*, 107*m*, 107*c*, and 107*k*.

The suffixes "y", "m", "c", and "k" of the respective reference symbols represent parts corresponding to the colors of yellow, magenta, cyan, and black, respectively. For example, the image forming units 120(*y, m, c, k*) indicate the image forming unit 120*y* of yellow, the image forming unit 120*m* of magenta, the image forming unit 120*c* of cyan, and the image forming unit 120*k* of black. In the following description, unless each part is required to be particularly distinguished from other parts, the image forming units 120(*y, m, c, k*) may be referred to simply as "image forming unit 120". The same applies to the photosensitive drums 101(*y, m, c, k*) and the other components.

The charge rollers 102(*y, m, c, k*) charge surfaces of the photosensitive drums 101(*y, m, c, k*). The developing devices 104(*y, m, c, k*) develop electrostatic latent images by causing toners to adhere to the photosensitive drums 101(*y, m, c, k*) corresponding thereto, respectively. A yellow toner image is formed and borne on the photosensitive drum 101*y*, and a magenta toner image is formed and borne on the photosensitive drum 101*m*. A cyan toner image is formed and borne on the photosensitive drum 101*c*, and a black toner image is formed and borne on the photosensitive drum 101*k*. The drum cleaner 107 removes the toner remaining on the photosensitive drum 101 corresponding thereto after the transferring onto an intermediate transfer belt 130.

The laser scanner units 103(*y, m, c, k*) emit light based on video signals obtained by digitally converting an image signal generated by the scanner section. The laser scanner units 103(*y, m, c, k*) include the laser scanner 103*y*, the laser scanner 103*m*, the laser scanner 103*c*, and the laser scanner 103*k*. The laser scanner 103*y* to the laser scanner 103*k* apply laser light corresponding to the video signals of yellow, magenta, cyan, and black to the corresponding photosensitive drum 101*y* to photosensitive drum 101*k*, respectively.

The intermediate transfer unit 140 includes the intermediate transfer belt 130, which is a belt member, and the primary transfer rollers 105(*y, m, c, k*). The primary transfer rollers 105(*y, m, c, k*) are provided so as to sandwich the intermediate transfer belt 130 between the primary transfer rollers 105(*y, m, c, k*) and the corresponding photosensitive drums 101(*y, m, c, k*), respectively. The primary transfer rollers 105(*y, m, c, k*) transfer the toner images of the corresponding colors formed on the corresponding photosensitive drums 101(*y, m, c, k*), respectively, to the intermediate transfer belt 130. The toner images of the respective colors are transferred onto the intermediate transfer belt 130 so as to be superimposed on each other, to thereby form a full-color toner image.

The secondary transfer roller 118 transfers the toner image, which has been transferred onto the intermediate transfer belt 130, onto a sheet. The sheet is conveyed to the secondary transfer roller 118 from a sheet feeding cassette 111 by a sheet feeding pickup roller 113, sheet feeding rollers 114, and registration rollers 116.

The fixing device 170 heats and pressurizes the sheet onto which the toner image has been transferred by the secondary transfer roller 118, to thereby fix the toner image on the sheet. This brings the image formation on the sheet to an end. The sheet on which the image has been formed is delivered from the fixing device 170 onto a delivery tray 132 by delivery rollers 139.

The UI 330 includes a key button, a display, and a touch panel to be operated by the user.

[Schematic Configuration of Image Forming Apparatus]

Figure 2:
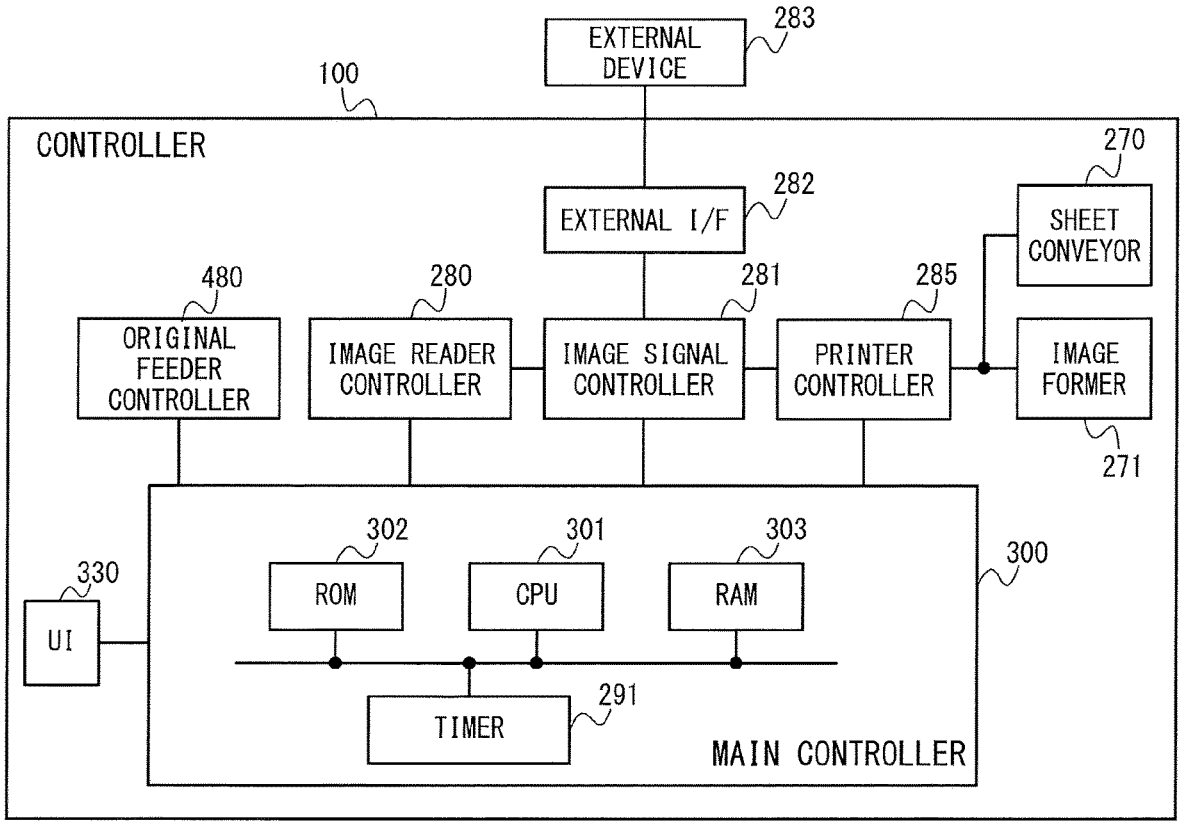
FIG. 2 is a control block diagram.

FIG. 2 is a control block diagram of the image forming apparatus according to this embodiment. A controller 100 is built into the image forming apparatus. A main controller 300 performs system control on the image forming apparatus illustrated in FIG. 1, and includes a CPU 301, a ROM 302, a RAM 303, and a timer 291.

The CPU 301 is a CPU configured to perform system control on the image forming apparatus. The CPU 301 is connected to the ROM 302 to which a control program is written and the RAM 303 configured to store a variable to be used for control and image data read by the image sensor 233. In this example, the CPU 301 is connected to, for example, the ROM 302 through an address bus and a data bus. The CPU 301 is also connected to the timer 291 capable of counting time. The CPU 301 sets a time count value of the timer 291 and acquires a timer measurement value. The CPU 301 performs different kinds of processing by reading computer programs from the ROM 302 and using the RAM 303 as a work area to execute the computer programs.

The CPU 301 causes an original feeder controller 480 to drive the original conveying roller 112 in the image forming apparatus of FIG. 1, and detect the presence or absence of an original using the original presence-or-absence sensor 151. The CPU 301 causes the image reader controller 280 to detect an open/close operation of an original pressing plate 54 and use the image sensor 233 to read an original image on the glass table 55 and an original image fed by the original feeder controller 480. After that, the CPU 301 transfers an analog image signal output from the image sensor 233 to an image signal controller 281.

At a time of a copying operation of the image forming apparatus, the image signal controller 281 converts the analog image signal received from the image sensor 233 into a digital image signal, then performs each kind of processing thereon, converts the digital image signal into a video signal, and outputs the video signal to a printer controller 285. At a time of a printing operation, the image signal controller 281 performs different kinds of processing on the digital image signal input from a computer or other such external device 283 through an external I/F 282. Then, the image signal controller 281 converts the digital image signal into a video signal, and outputs the video signal to the printer controller 285.

The printer controller 285 instructs an image former 271 to form an image based on an instruction given by the CPU 301. The image former 271 drives the image forming unit 120 based on the input video signal. The printer controller 285 also causes a sheet conveyor 270 to feed a sheet and control conveyance thereof based on an instruction given by the CPU 301.

The UI 330 corresponds to the operating section illustrated in FIG. 1, and receives, from the user, an instruction to select the mode for performing the image formation, an instruction to display a state of the image forming apparatus, an instruction to start copying, and other such instruction. In this embodiment, the image forming apparatus has two modes, namely, the monochrome mode for forming a monochrome image and the full-color mode for forming a color image.

[Basic Image Forming Operation of Image Forming Apparatus]

Next, with reference to FIG. 1 and FIG. 2, a description is given of a basic image forming operation of the image forming apparatus. When receiving an instruction to start the image forming operation from the external device 283 through the external I/F 282, the image signal controller 281 performs different kinds of processing on the digital image signal input through the external I/F 282. The image signal controller 281 also determines the mode depending on whether the image to be formed is a color image or a monochrome image.

The CPU 301 controls the position of the primary transfer rollers 105 in the intermediate transfer unit 140 in accordance with the mode determined by the image signal controller 281, and also causes the image former 271 to control the image forming unit 120 for start preparation of the image forming operation.

The image forming units 120(*y, m, c, k*) include the photosensitive drums 101(*y, m, c, k*), the developing devices 104(*y, m, c, k*), the charge rollers 102(*y, m, c, k*), and the drum cleaners 107(*y, m, c, k*). The position control of the intermediate transfer unit 140 is described later in detail.

When the switching of an abutted state of the intermediate transfer unit 140 and the preparation for the image forming units 120(*y, m, c, k*) are completed, the CPU 301 causes the image former 271 to control each of the image forming units 120(*y, m, c, k*). With this control, the CPU 301 starts the image forming operation for the image data stored in the RAM 303. In each of the image forming units 120(*y, m, c, k*), after the surface of the photosensitive drum 101 is charged, the latent image is formed on the photosensitive drum 101 with laser light emitted from the laser scanner unit 103.

The latent image that has been formed is developed on the photosensitive drum 101 with the toner contained in the developing device. After that, a primary transfer voltage is applied to the toner image developed on the photosensitive drum 101 in each of the monochrome primary transfer roller 105*k* and the color primary transfer rollers 105(*y, m, c*), and the toner image is transferred onto the intermediate transfer belt 130. The toner image transferred onto the intermediate transfer belt 130 reaches the secondary transfer roller 118 in accordance with the rotation of the intermediate transfer belt 130.

The CPU 301 causes the sheet conveyor 270 to drive a conveyance motor (not shown) so as to have a sheet reach the secondary transfer roller 118 in time for a timing at which the toner image reaches the secondary transfer roller 118. The conveyance motor is a drive source for the sheet feeding pickup roller 113, the sheet feeding rollers 114, the registration rollers 116, and the delivery rollers 139. In response thereto, the sheet feeding pickup roller 113 is driven to rotate, and sheets are fed and conveyed from the sheet feeding cassette 111 one by one. In the above-mentioned manner, a secondary transfer voltage is applied to the sheet and the toner image that have reached the secondary transfer roller 118, to thereby transfer the toner image onto the sheet.

The sheet onto which the toner image has been transferred is conveyed to the fixing device 170. As described above, in the fixing device 170, the toner image on the sheet is heated to be fixed to the sheet. After that, the CPU 301 delivers the sheet onto the delivery tray 132 using the delivery rollers 139 controlled by a sheet feeder/conveyor. When the printing operation is completed, the CPU 301 switches an abutted/separated state of the intermediate transfer unit 140 to the abutted state during standby. The abutted state during standby is described later in detail.

The above-mentioned basic image forming operation is merely an example, and the present disclosure is not limited to the above-mentioned configuration.

[Description of Abutment and Separation for Primary Transfer]

Next, a description is given of a mechanism for controlling the abutment and separation of the intermediate transfer belt 130 and the photosensitive drum 101 (hereinafter referred to as "abutment/separation mechanism") in this embodiment.

Figure 3A:
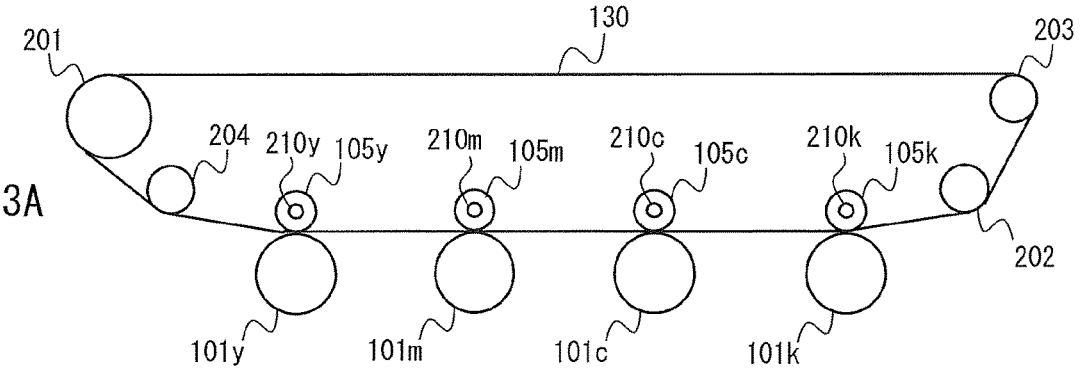
FIG. 3A, FIG. 3B, FIG. 3C, and FIG. 3D are explanatory views for illustrating an intermediate transfer unit.

FIG. 3A to FIG. 3D are explanatory views for illustrating the vicinity of the intermediate transfer unit 140 which are viewed from the front side of the image forming apparatus in this embodiment. As illustrated in FIG. 3A, the intermediate transfer belt 130 is looped around a drive roller 201, an idler roller 202, a secondary transfer inner roller 203, and a tension roller 204. Each of those rollers is rotated by an intermediate transfer belt motor (not shown). The intermediate transfer belt 130 is rotated in accordance with the rotation of the rollers. The primary transfer rollers 105(*y, m, c, k*) having both ends supported rotatably by the corresponding bearings 210(*y, m, c, k*) are arranged inside the intermediate transfer belt 130.

FIG. 3A to FIG. 3D are illustrations of the primary transfer rollers 105(*y, m, c, k*) and the bearings 210(*y, m, c, k*), and the illustrations are given for the sake of convenience of showing a positional relationship between the primary transfer rollers 105(*y, m, c, k*) and the bearings 210(*y, m, c, k*). In an actual case, the bearings 210(*y, m, c, k*) are located behind the primary transfer rollers 105(*y, m, c, k*), respectively. Each of those bearings 210(*y, m, c, k*) is guided so as to move along a straight line (vertical direction in FIG. 3A to FIG. 3D) by a frame, and biased in the direction toward each of the photosensitive drums 101(*y, m, c, k*) by a spring (not shown).

The photosensitive drums 101(*y, m, c, k*) are driven by drum motors of yellow, magenta, cyan, and black (not shown), respectively. FIG. 3A is a sectional view of the vicinity of the intermediate transfer unit 140 at the fully abutted position in the full-color mode. When the image forming apparatus performs printing in the full-color mode, the primary transfer rollers 105(*y, m, c, k*) move to the fully abutted position. It is required to form images of all the colors, and hence the primary transfer rollers 105(*y, m, c, k*) are all abutted against the corresponding photosensitive drums 101(*y, m, c, k*) through intermediation of the intermediate transfer belt 130.

Figure 3B:
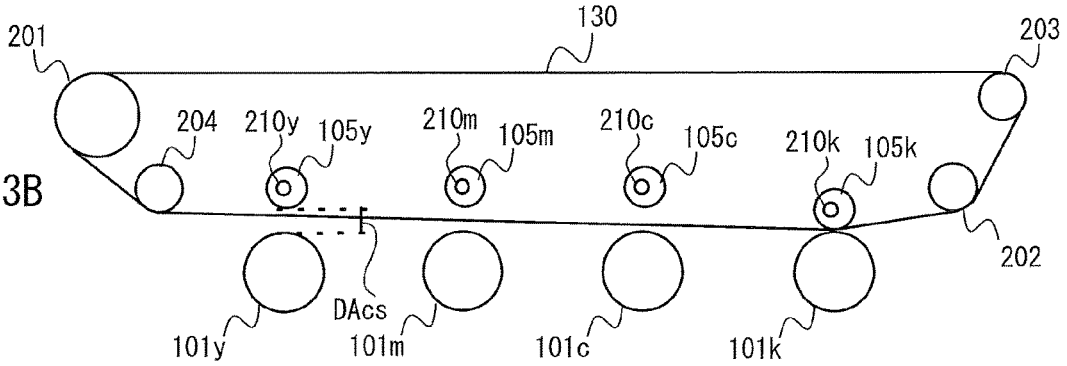

FIG. 3B is a sectional view of the vicinity of the intermediate transfer unit 140 at a position (hereinafter referred to as "standby position") at which each of the primary transfer rollers 105(*y, m, c, k*) in a standby mode is in a standby state. The standby position is a predetermined position between the fully abutted position described above and the monochrome position described later. At the standby position, the primary transfer rollers 105(*y, m, c, k*) move to the positions illustrated in FIG. 3B.

As illustrated in FIG. 3B, at the standby position, only the primary transfer roller 105*k* of black is abutted against the photosensitive drum 101*k* of black through intermediation of the intermediate transfer belt 130. The primary transfer rollers 105(*y, m, c*) of yellow, magenta, and cyan have been retracted upward, which keeps the intermediate transfer belt 130 from being brought into contact with the photosensitive drums 101(*y, m, c*) of yellow, magenta, and cyan. The photosensitive drums 101(*y, m, c*) are separated from the primary transfer rollers 105(*y, m, c*), and thus the respective drum motors configured to drive those components are also brought to a stop. In FIG. 3B, a distance between the primary transfer roller 105*y* and the photosensitive drum 101*y* in the standby mode is represented by a standby separation distance DAcs.

Figure 3C:
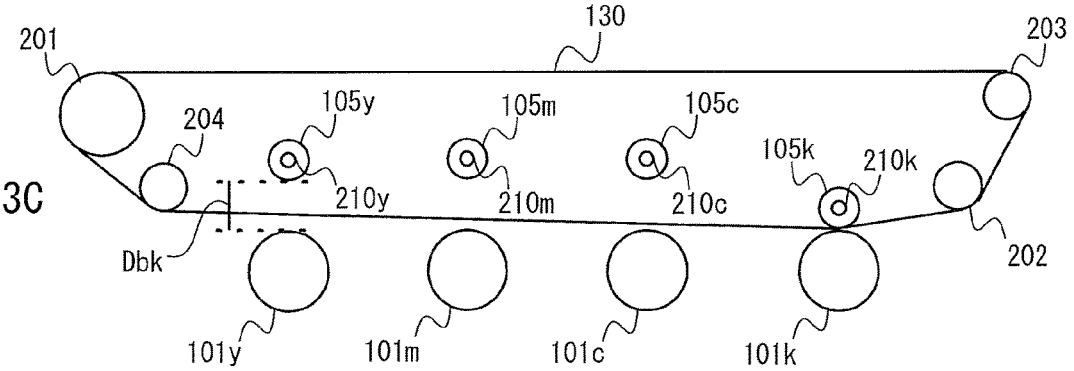

FIG. 3C is a sectional view of the vicinity of the intermediate transfer unit 140 at the monochrome position in the monochrome mode. When the image forming apparatus performs printing in the monochrome mode, the primary transfer rollers 105(*y, m, c, k*) move to the monochrome position illustrated in FIG. 3C. Only a black image is formed at the monochrome position illustrated in FIG. 3C. In the same manner as in FIG. 3B, at the monochrome position, only the primary transfer roller 105*k* is abutted against the photosensitive drum 101*k* of black through intermediation of the intermediate transfer belt 130. The primary transfer rollers 105(*y, m, c*) are separated from the intermediate transfer belt 130 and the photosensitive drums 101(*y, m, c*).

The primary transfer rollers 105(*y, m, c*) are separated from the photosensitive drums 101(*y, m, c*), and thus a drum motor Y, a drum motor M, and a drum motor C that are configured to drive those components are also brought to a stop.

In FIG. 3C, a distance between the primary transfer roller 105*y* and the photosensitive drum 101*y* in the monochrome mode is represented by a monochrome separation distance Dbk (>DAcs).

Referring back to FIG. 3B, the positions of the primary transfer rollers 105(*y, m, c*) at the standby position can be freely set to any positions between the positions at the fully abutted position and the positions at the monochrome position. In this embodiment, the positions of the primary transfer rollers 105(*y, m, c*) at the standby position are set to positions at which downtime is zero at a time of switching from the standby mode to the monochrome mode. However, the positions may be set to positions at which the downtime is equal between the time of switching from the standby mode to the monochrome mode and a time of switching from the standby mode to the full-color mode. In addition, the standby separation distance DAcs may be set to have one half the value of the monochrome separation distance Dbk to set the moving distance of each of the primary transfer rollers 105(*y, m, c*) equal between the monochrome mode and the full-color mode.

Figure 3D:
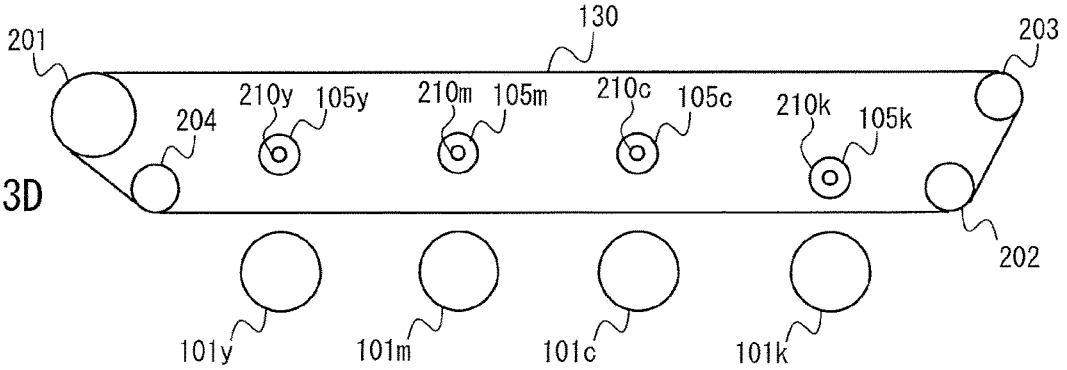

FIG. 3D is a sectional view of the vicinity of the intermediate transfer unit 140 at the fully separated position at which all the primary transfer rollers 105(*y, m, c, k*) are separated from the photosensitive drums 101(*y, m, c, k*). When a predetermined time has elapsed while the image forming apparatus remains at the standby position, the primary transfer rollers 105(*y, m, c, k*) move to the fully separated position for standby. At this time, the primary transfer rollers 105(*y, m, c, k*) are separated from the intermediate transfer belt 130 and the photosensitive drums 101(*y, m, c, k*).

In this embodiment, the distance between the primary transfer rollers 105(*y, m, c*) and the photosensitive drums 101(*y, m, c*) at the standby position is set as the standby separation distance DAcs for each of the colors y, m, c, as shown in FIG. 3B, and the distance between the primary transfer rollers 105(*y, m, c*) and the photosensitive drums 101(*y, m, c*) at the monochrome position is set as the monochrome separation distance Dbk for each of the colors y, m, c as shown in FIG. 3C. Both the values of DAcs and Dbk for yellow, magenta, and cyan are equal to one another, and hence in this embodiment, the values between the primary transfer roller 105 and the photosensitive drum 101 for yellow are set to DAcs and Dbk.

However, other methods may be used to measure the distance between the primary transfer roller 105 and the photosensitive drum 101. For example, the distance between the primary transfer roller 105*m* and the photosensitive drum 101*m* for magenta or between the primary transfer roller 105*c* and the photosensitive drum 101*c* for cyan may be measured.

This embodiment is further configured to move the positions of the primary transfer rollers 105(*y, m, c, k*) without changing the positions of the photosensitive drums 101(*y, m, c, k*). However, it is also possible to change the positions of the photosensitive drums 101(*y, m, c, k*) without changing the positions of the primary transfer rollers 105(*y, m, c, k*). In another case, the positions of both the primary transfer rollers 105(*y, m, c, k*) and the photosensitive drums 101(*y, m, c, k*) may be changed to set relative positions therebetween so as to achieve DAcs and Dbk described above.

(Description of Abutment and Separation Configuration for Primary Transfer)

Next, with reference to FIG. 4A to FIG. 4D, FIG. 5A to FIG. 5D, and FIG. 6, a specific description is given of the switching of the positions of the primary transfer rollers 105(*y, m, c, k*) based on the switching of the mode.

Figure 4A:
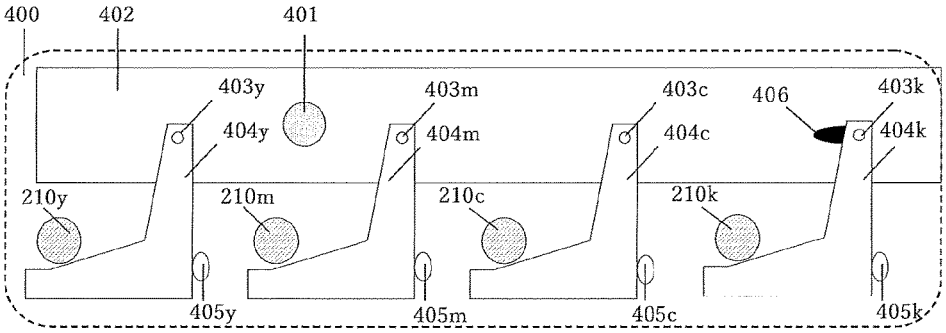
FIG. 4A, FIG. 4B, FIG. 4C, and FIG. 4D are explanatory views for illustrating an abutment/separation mechanism.
Figure 4B:
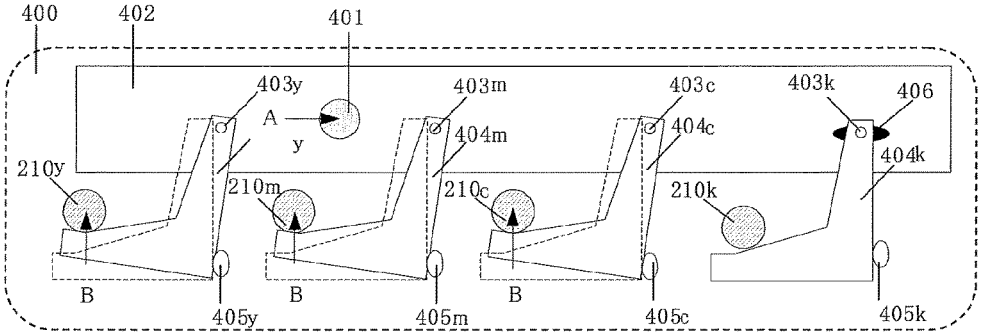
Figure 4C:
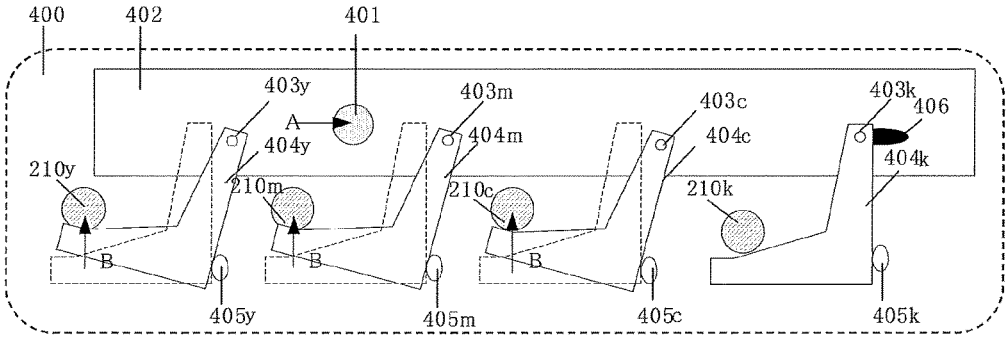
Figure 4D:
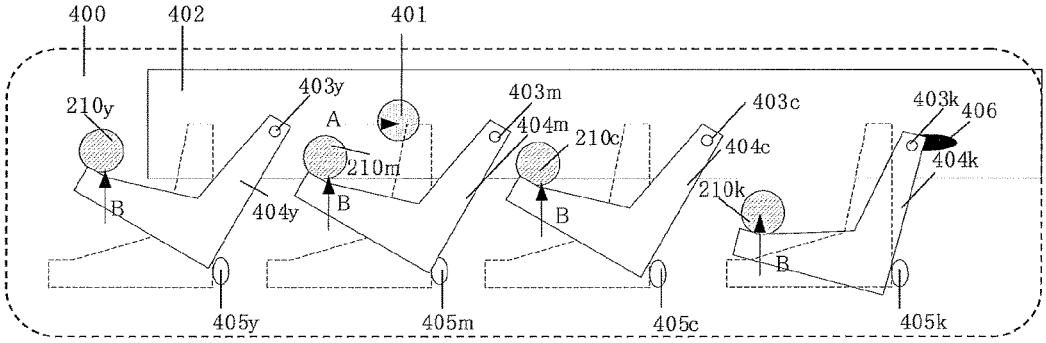

FIG. 4A to FIG. 4D are explanatory views for illustrating an abutment/separation mechanism 400 serving as a moving unit, which is configured to respectively move the primary transfer rollers 105(*y, m, c, k*), and which is viewed from the front side of the image forming apparatus. A slider 402 forms the abutment/separation mechanism 400, and is configured to slide along the horizontal direction. FIG. 4A is an illustration of a state before the slider 402 slides, and FIG. 4B, FIG. 4C, and FIG. 4D are illustrations of states in which the slider 402 gradually slides in a direction A in the stated order. Operations exhibited at a time of the sliding are described later.

First, with reference to FIG. 4A to FIG. 4D, a description is given of a configuration of the abutment/separation mechanism 400. FIG. 4A corresponds to FIG. 3A, and is an illustration of a state in which the slider 402 is at the leftmost position among FIG. 4A to FIG. 4D with the bearings 210(*y, m, c, k*) being located at the lowermost positions in FIG. 4A. In FIG. 4A, the slide lever 401 is fixedly connected to the slider 402. Lift arms 404(*y, m, c, k*) support the bearings 210(*y, m, c, k*) of the primary transfer rollers 105(*y,m,c,k*), respectively, from lower portions thereof. The lift arms 404(*y, m, c, k*) are rotatably supported by arm bearings 403(*y, m, c, k*) provided to the slider 402. The positions of the arm bearings 403(*y, m, c*) are fixed with respect to the slider 402, while the arm bearing 403*k* is arranged in a slit 406 provided to the slider 402 and elongated in the horizontal direction.

The slider 402, the arm bearings 403(*y, m, c, k*), and the lift arms 404(*y, m, c, k*) are all capable of moving in the horizontal direction in FIG. 4A to FIG. 4D. In addition, the bearings 210(*y, m, c, k*) are mounted on the lift arms 404(*y, m, c, k*), respectively, and the mounted bearings 210(*y, m, c, k*) are caused to move in accordance with the movement of the lift arms 404(*y, m, c, k*).

Meanwhile, the positions of slider arm support portions 405(*y, m, c, k*) illustrated in FIG. 4A are fixed. The lift arms 404(*y, m, c, k*) are arranged so as to be abutted against the slider arm support portions 405(*y, m, c, k*) and to be rotatable about contact portions thereof. When the slider 402 moves in the horizontal direction, the arm bearings 403(*y, m, c*) also move in the horizontal direction.

When the slider 402 moves in the rightward direction from the state of FIG. 4A, the arm bearings 403(*y, m, c*) also move in the rightward direction to cause the lift arms 404(*y, m, c*) to rotate about the contact portions with respect to the slider arm support portions 405(*y, m, c*).

Meanwhile, even when the slider 402 moves in parallel in the horizontal direction, the arm bearing 403*k* does not move until the arm bearing 403*k* is brought into contact with an end portion of the slit 406, and hence the lift arm 404*k* does not rotate as well. FIG. 4B is an illustration of a state in which the slit 406 has moved in the rightward direction to bring the arm bearing 403*k* to a position between the right end and the left end of the slit 406.

In FIG. 4B, the position of the arm bearing 403*k* does not change, which does not change the position of the bearing 210*k* as well, and hence the lift arm 404*k* also does not move. As a result, as illustrated in FIG. 3B, the primary transfer roller 105*k* also does not move. The positions of the arm bearings 403(*y, m, c*) move rightward, and as a result, the lift arms 404(*y, m, c*) rotate about the slider arm support portions 405(*y, m, c*). Therefore, the bearings 210(*y, m, c*) move upward as indicated by the arrows B in FIG. 4B, and hence as illustrated in FIG. 3B, the primary transfer rollers 105(*y, m, c*) move upward. This state corresponds to the standby position of FIG. 3B.

FIG. 4C is an illustration of a state in which the slit 406 has further moved in the rightward direction from the state of FIG. 4B to cause the arm bearing 403*k* to reach the left end of the slit 406. Even in this state, the lift arm 404*k* does not move, and hence the primary transfer roller 105*k* does not move as well. Meanwhile, when the arm bearings 403(*y, m, c*) further move rightward to cause the lift arms 404(*y, m, c*) to further rotate, the positions of the bearings 210(*y, m, c*) further move upward, and the primary transfer rollers 105(*y, m, c*) further move upward as well. This state corresponds to the monochrome position FIG. 3C.

FIG. 4D is an illustration of a state in which the slit 406 has further moved in the rightward direction from the state of FIG. 4C. In this state, the arm bearing 403*k* moves to the right in a state of being in contact with the left end of the slit 406, and hence the lift arm 404*k* is rotated to move the bearing 210*k* upward. As a result, the primary transfer roller 105*k* moves upward. Meanwhile, the arm bearings 403(*y, m, c*) further move to the right, and the lift arms 404(*y, m, c*) further rotate, to thereby move the positions of the bearings 210(*y, m, c*) upward as well. As a result, the primary transfer rollers 105(*y, m, c*) further move upward. This state corresponds to the fully separated position of FIG. 3D.

Figure 5A:
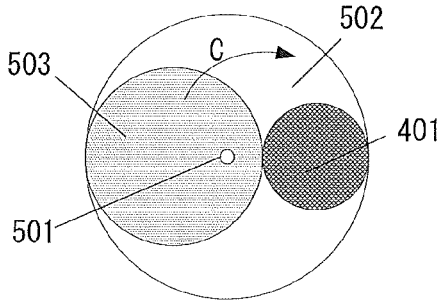
FIG. 5A, FIG. 5B, FIG. 5C, and FIG. 5D are explanatory views for illustrating a cam structure.

FIG. 5A to FIG. 5D are explanatory views for illustrating a cam structure for sliding the slider 402 described with reference to FIG. 4A to FIG. 4D in the horizontal direction. As illustrated in FIG. 5A, the slide lever 401 fixedly connected to the slider 402 is arranged in contact with an eccentric cam 503 of the cam gear 502. The cam gear 502 rotates about a gear shaft 501. The state of FIG. 5A corresponds to the fully abutted position being the state illustrated in FIG. 4A in which the bearings 210(*y, m, c, k*) are located downward with the primary transfer rollers 105(*y, m, c, k*) being located downward.

Next, a description is given of an operation for rotating the cam gear 502. The gear shaft 501 illustrated in FIG. 5A to FIG. 5D is rotated by the abutment/separation motor 504 illustrated in FIG. 6, and is driven to rotate forward or reverse, and the cam gear 502 is caused to rotate in accordance with its rotation. For the simplicity of the drawings, the abutment/separation motor 504 is not illustrated in FIG. 5A to FIG. 5D.

Figure 5B:
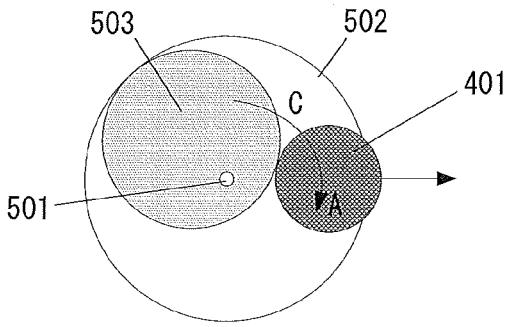

FIG. 5B is an illustration of a state in which the abutment/separation motor 504 has been driven to rotate forward from the state of FIG. 5A to cause the cam gear 502 to rotate in a direction C, to thereby bring the arm bearing 403*k* to a position between the left end and the right end of the slit 406. In FIG. 5B, the eccentric cam 503 has pushed the slide lever 401 in the direction A by the rotation of the cam gear 502. As a result, the slider 402 moves in the rightward direction in FIG. 4A to FIG. 4D. At this time, as illustrated in FIG. 4B, the end portions supporting the bearings 210(*y, m, c*) of the lift arms 404(*y, m, c*) are raised in a direction B with the slider arm support portions 405(*y, m, c*) being fulcra.

When the bearings 210(*y, m, c*) are raised, the primary transfer rollers 105(*y, m, c*) of yellow, magenta, and cyan are pushed upward. This situation corresponds to the standby position described with reference to FIG. 3B. Meanwhile, the arm bearing 403*k* of the lift arm 404*k* does not move until the arm bearing 403*k* is brought into contact with the left end of the slit 406. As illustrated in FIG. 4B, the arm bearing 403*k* is located at the position between the left end and the right end of the slit 406, and hence the lift arm 404*k* does not rotate at this time point.

Figure 5C:
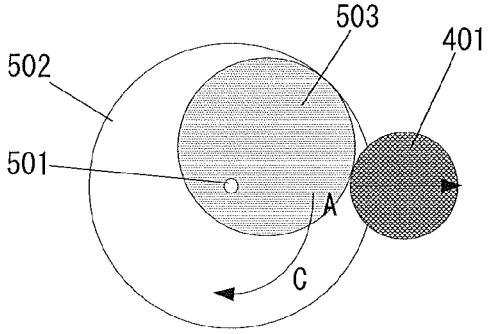

FIG. 5C is an illustration of a state in which the abutment/separation motor has been further driven to rotate forward from the state of FIG. 5B. In this state, the eccentric cam 503 has further pushed the slide lever 401 further in the direction A than that in FIG. 5B. As a result, the slider 402 further moves in the rightward direction in FIG. 4A to FIG. 4D. At this time, as illustrated in FIG. 4C, end portions of the lift arms 404(*y, m, c*) that support the bearings 210(*y, m, c*) are further raised in the direction B. This situation corresponds to the monochrome position described with reference to FIG. 3C. When the bearings 210(*y, m, c*) are raised, the primary transfer rollers 105(*y, m, c*) of yellow, magenta, and cyan are raised to be retracted upward. Therefore, the intermediate transfer belt 130 is separated from the photosensitive drums 101(*y, m, c*) of yellow, magenta, and cyan. Meanwhile, the arm bearing 403*k* has been brought into contact with the left end of the slit 406 without changing its position. Therefore, the primary transfer roller 105*k* of black is still abutted against the photosensitive drum 101*k* of black through intermediation of the intermediate transfer belt 130.

In this manner, the abutment/separation motor 504 and the slider 402 operate as a moving unit configured to move the primary transfer rollers 105(*y, m, c*) and the primary transfer roller 105*k*. Therefore, in the first embodiment, the primary transfer rollers 105(*y, m, c*) and the primary transfer roller 105*k* are moved by one moving unit. However, there may be employed other configurations of using separate moving units to move the primary transfer rollers 105(*y, m, c*) and the primary transfer roller 105*k*.

Figure 5D:
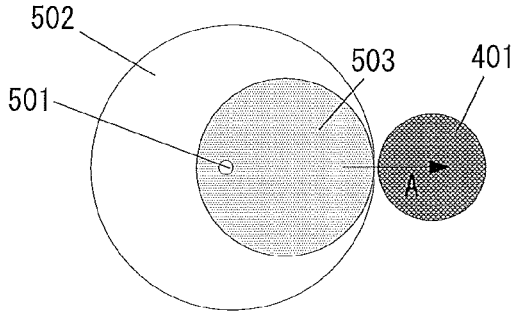

FIG. 5D is an illustration of a state in which the abutment/separation motor has been further driven to rotate forward from the state of FIG. 5C to be rotated by 180° from the state of FIG. 5A. This is a state in which the slider 402 has been pushed furthest in the direction A. As illustrated in FIG. 5D, the end portions of the lift arms 404(*y, m, c*) that support the bearings 210(*y, m, c*) are further raised in the direction B. When the bearings 210(*y, m, c*) are raised, the primary transfer rollers 105(*y, m, c*) of yellow, magenta, and cyan are further raised. Therefore, the intermediate transfer belt 130 is separated from the photosensitive drums 101(*y, m, c*) of yellow, magenta, and cyan. Further, the arm bearing 403*k* follows the movement of the slider 402 to move in the rightward direction while being kept in contact with the left end of the slit 406, and hence the bearing 210*k* is raised. As a result, the primary transfer roller 105*k* is separated from the photosensitive drum 101*k*.

Therefore, in the state of FIG. 5D, the primary transfer rollers 105(*y, m, c, k*) of all the colors have been pushed upward as illustrated in FIG. 4D. This situation corresponds to the fully separated position of FIG. 3D.

Meanwhile, when the abutment/separation motor is driven to rotate reversely, the cam gear 502 is caused to rotate in a direction reverse to the direction C. That is, when the abutment/separation motor is driven to rotate reversely from the state of FIG. 5D, the state shifts in the order of the states of FIG. 5C, FIG. 5B, and FIG. 5A.

Figure 6:
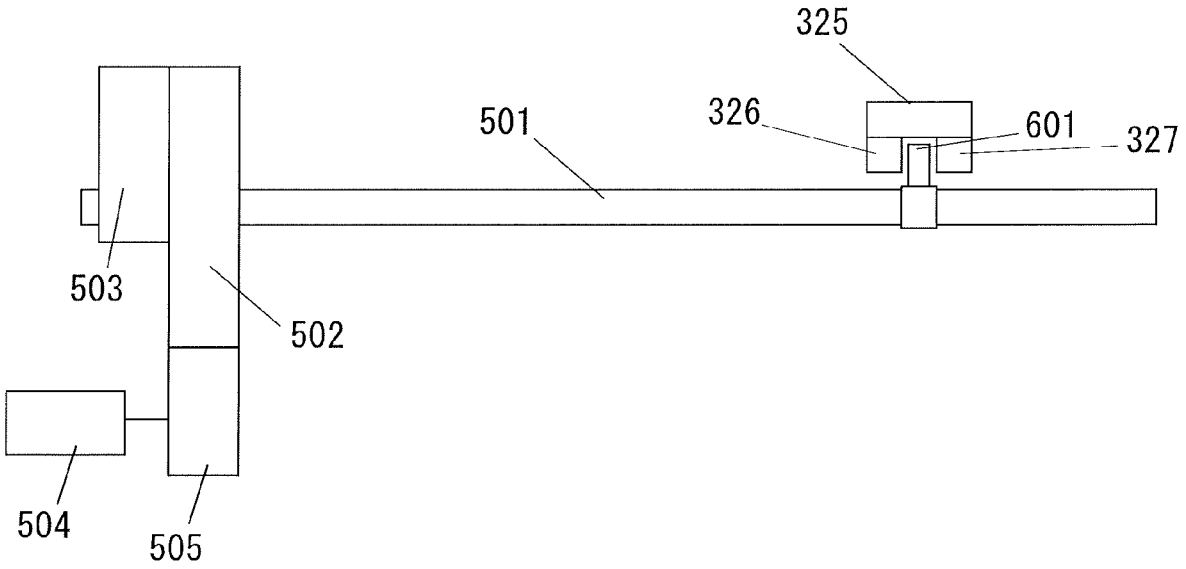
FIG. 6 is a plan view for illustrating a gear shaft.

FIG. 6 is a plan view of the cam gear 502, the eccentric cam 503, and the gear shaft 501. As illustrated in FIG. 6, the abutment/separation motor 504 is connected to the gear shaft 501, and a flag 601 configured to detect the standby position is fixed to the gear shaft 501. The flag 601 is provided so as to protrude from the gear shaft 501. As described with reference to FIG. 5A to FIG. 5D, when the abutment/separation motor 504 is driven, the cam gear 502 is rotated through intermediation of the driving gear 505. This causes the eccentric cam 503 to rotate as well, to thereby move the slide lever 401 in the rightward direction in FIG. 5A to FIG. 5D, and the states of the eccentric cam 503, the slide lever 401, or other such component are switched in the order of the states of FIG. 5A, FIG. 5B, FIG. 5C, and FIG. 5D. Then, the flag 601 is rotated through intermediation of the gear shaft 501 in conjunction with the rotation of the cam gear 502.

The image forming apparatus includes a sensor 325 configured to detect that the primary transfer roller 105 is located at the standby position. The sensor 325 includes a light emitter 326 and a light receiver 327 configured to receive a light beam from the light emitter 326. The sensor 325 is provided so that, when the cam gear 502 rotates to be located at a position corresponding to the standby position of FIG. 5B, the flag 601 is brought to a position between the light emitter 326 and the light receiver 327 to block the light beam. Meanwhile, when the cam gear 502 is not located at the standby position, the flag 601 is not located between the light emitter 326 and the light receiver 327, which allows the light receiver 327 to receive the light beam from the light emitter 326.

Therefore, in FIG. 5A, FIG. 5C, and FIG. 5D, the light receiver 327 receives the light beam from the light emitter 326. As illustrated in FIG. 6, it is indicated that, when the flag 601 blocks the light beam in the sensor 325, the cam gear 502 is located at the standby position illustrated in FIG. 3B, FIG. 4B, and FIG. 5B.

The configuration for moving the primary transfer rollers 105(*y, m, c, k*) up and down and the configuration for detecting the standby position described above are merely examples, and freely-selected methods can be used to perform the moving up and down and the detection.

Figure 7A:
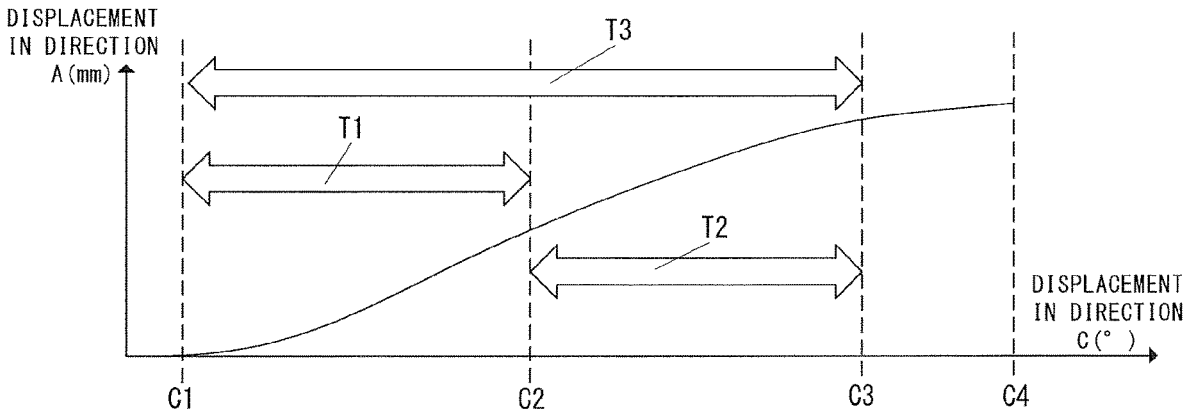
FIG. 7A is an explanatory graph for showing a relationship between a displacement amount of a cam gear and a position of a primary transfer roller.
Figure 7B:
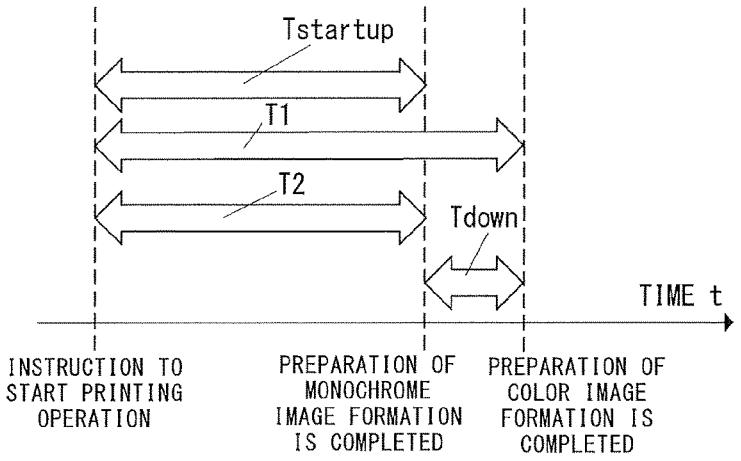
FIG. 7B is a timing chart thereof.

Next, with reference to FIG. 7A and FIG. 7B, a description is given of reduction in downtime based on the switching of the positions of the primary transfer rollers 105(*y, m, c, k*) at a time of execution of a print job. In this embodiment, information representing a series of image forming operations to be performed on one or a plurality of sheets, which involves the instruction to start the image forming operation, is referred to as "print job".

FIG. 7A is an explanatory graph for showing a relationship between a displacement amount of the cam gear 502 described with reference to FIG. 5A to FIG. 5D in terms of the direction C and the respective positions of the primary transfer rollers 105(*y,m,c,k*). In FIG. 7A, the horizontal axis represents a rotation angle (rad) of the cam gear 502, and the vertical axis (direction A) represents the displacement amount (mm) of the slide lever 401 and the slider 402.

As described with reference to FIG. 5A to FIG. 5D, when the cam gear 502 rotates in the direction C, the slide lever 401 is displaced in the direction A, and the positions of the primary transfer rollers 105(*y, m, c, k*) change depending on the displacement amount.

In FIG. 7A, C1 represents the rotation angle of the cam gear 502 at the fully abutted position illustrated in FIG. 5A, and this rotation angle is set as 0° for the sake of convenience. The eccentric cam 503 does not interfere with the slider 402, and hence the displacement in the direction A at C1 of FIG. 7A, which corresponds to FIG. 5A, is 0.

C2 corresponds to the rotation angle of the cam gear 502 at the standby position illustrated in FIG. 5B. C3 corresponds to the rotation angle of the cam gear 502 at the monochrome position illustrated in FIG. 5C. C4 corresponds to the rotation angle of the cam gear 502 at the fully separated position illustrated in FIG. 5D, and the rotation angle is 180°. Therefore, a relationship of C1=0 and C1<C2<C3<180° is established.

In FIG. 7A, T1 represents a time required for the cam gear 502 to rotate from C1 to C2, T2 represents a time required for the cam gear 502 to rotate from C2 to C3, and T3 represents a time required for the cam gear 502 to rotate from C1 to C3. Therefore, T1 indicates a time required for the primary transfer rollers 105(*y, m, c*) to move from the fully abutted position to the standby position. T2 indicates a time required for the primary transfer rollers 105(*y, m, c*) to move from the standby position to the monochrome position. T3 indicates a time required for the primary transfer rollers 105(*y, m, c*) to move from the fully abutted position to the monochrome position.

As described with reference to FIG. 5A to FIG. 5D, while the cam gear 502 rotates in the direction C, the displacement of the slide lever 401 illustrated in FIG. 4B to FIG. 4D in the direction A gradually increases.

In this case, angular velocity in the rotation in the direction C based on the above-mentioned driving of the abutment/separation motor is constant, and hence the moving speed of the slide lever 401 in the direction A gradually increases as the cam gear 502 rotates from C1 to C2. As shown in FIG. 7A, a displacement speed of the slide lever 401 in the direction A, which is illustrated in FIG. 4B to FIG. 4D, is maximized in the vicinity of C2. After that, as the cam gear 502 moves toward C3 and C4, the displacement speed of the slide lever 401 in the direction A gradually decreases.

In addition, as shown in FIG. 7A, a relationship of T3=T1+T2 is established. Therefore, T1 and T2 are both smaller than T3.

In the example of FIG. 7A, C2 is located near the midpoint between C1 and C3, but a freely-selected position between C1 and C3 can be determined as the position of C2. By moving C2 closer to C1, it is possible to decrease T1 and increase T2. Meanwhile, by moving C2 closer to C3, it is possible to increase T1 and decrease T2. Therefore, the values of T1 and T2 can be freely determined while satisfying the relationship of T3=T1+T2.

FIG. 7B is a timing chart for illustrating a time required after an instruction to start the printing operation is input to the image forming apparatus until preparation of image formation is completed. In FIG. 7B, a preparation operation time Tstartup, the above-mentioned time T1, and the above-mentioned time T2 are illustrated.

When the instruction to start the printing operation is input to the image forming apparatus, the CPU 301 switches the positions of the primary transfer rollers 105(*y, m, c, k*) depending on the mode to perform a preparation operation of image formation for the image forming units 120(*y, m, c, k*).

The CPU 301 starts the image forming operation after both the switching of the position of the primary transfer roller 105 and the preparation operation are completed. In this embodiment, the time T2 required until the cam gear 502 has rotated from C2 to C3 is set equal to the preparation operation time Tstartup for the image forming units 120(*y, m, c, k*). To that end, the standby position C2 is adjusted so as to satisfy T2=Tstartup.

Therefore, when the primary transfer rollers 105(*y, m, c, k*) are at the standby position, regarding a print job for a monochrome image, the time T2 for switching from the standby position to the monochrome position is equal to the preparation operation time Tstartup, which causes no downtime.

When the primary transfer rollers 105(*y, m, c, k*) are at the standby position, regarding a full-color print job, the time T1 for switching from the standby position to the fully abutted position is longer than the preparation operation time Tstartup. Therefore, in this case, there occurs downtime Tdown=T1−Tstartup. However, as described with reference to FIG. 7A, the time T1 for moving from the standby position to the fully abutted position is shorter than the time T3 for moving from the fully abutted position to the monochrome position. Therefore, the downtime is reduced as compared with a case in which the image forming apparatus stands by at the monochrome position C3.

Note that, in this embodiment, the standby position C2 is set so as to satisfy T1>T2, but relationship in magnitude of T1 and T2 may be reversed as T1<T2. In another case, T1=T2 may be set.

In this embodiment, T3=T1+T2>Tstartup is established, and hence it is not possible to simultaneously satisfy Tstartup≥T1 and Tstartup≥T2. However, when a print job for a color image is more often received by the image forming apparatus than a print job for a monochrome image, T1 may be set equal to or smaller than a preparation operation period (T1≤Tstartup) to cause downtime at a time of color image formation to become 0. In this case, downtime (T2−Tstartup) occurs at the time of the monochrome image formation, but the monochrome image formation is requested less often, and hence an occurrence frequency of the downtime can be suppressed to a low level.

In the same manner, when the print job for a monochrome image is more often received by the image forming apparatus than the print job for a color image, T2≤Tstartup may be set to cause downtime at the time of the monochrome image formation to become 0. In this case, downtime (T1−Tstartup) occurs at the time of the color image formation, but the color image formation is requested less often, and hence the occurrence frequency of the downtime can be suppressed to a low level.

In particular, the CPU 301 can achieve such a configuration as described above by including a function of calculating the occurrence frequencies of the monochrome mode and the full-color mode. In this case, the CPU 301 determines whether to set T1≤Tstartup or T2≤Tstartup depending on the detected occurrence frequency.

It is also possible to set both T1 and T2 smaller than Tstartup by, for example, raising a rotation speed of the abutment/separation motor to decrease T3. In this case, the downtime Tdown due to the switching of the positions of the primary transfer rollers 105(*y, m, c, k*) can be set to 0 irrespective of the mode. The above-mentioned times T1, T2, and Tstartup are merely examples, and the present disclosure is not limited to the above-mentioned configuration.

In this embodiment, in the operation of the image forming apparatus, the primary transfer rollers 105(*y, m, c, k*) are moved to the standby position after the image formation is completed in both the full-color mode and the monochrome mode. When the image formation is performed in the full-color mode after the image forming apparatus receives a print job and the mode is determined, the abutment/separation motor is driven in the reverse direction before the image formation is started. With this driving, the primary transfer rollers 105(*y, m, c, k*) are moved from the standby position to the fully abutted position. Meanwhile, when the image formation is performed in the monochrome mode, the abutment/separation motor is driven in the forward direction before the image formation is started. With this driving, the primary transfer rollers 105(*y, m, c, k*) are moved from the standby position to the monochrome position.

In the related art, there is a case in which, when the image forming apparatus is in a state of being in the standby mode, the primary transfer rollers 105(*y, m, c, k*) are located at the fully abutted position for forming a color image. When the image forming apparatus receives a print job for forming a monochrome image in this state, the positions of the primary transfer rollers 105(*y, m, c, k*) are required to be switched from the fully abutted position to the monochrome position. In the same manner, there is a case in which, when the image forming apparatus is in the state of being in the standby mode, the primary transfer rollers 105(*y, m, c, k*) may be located at the monochrome position for forming a monochrome image. When the image forming apparatus receives a print job for forming a color image in this state, the positions of the primary transfer rollers 105(*y, m, c, k*) are required to be switched from the monochrome position to the fully abutted position. In any one of the cases, the switching of the positions of the primary transfer rollers 105(*y, m, c, k*) requires a long time equivalent to T3 of FIG. 7A, which causes the downtime to become longer.

Meanwhile, as described with reference to FIG. 1 to FIG. 7B, according to this embodiment, the primary transfer rollers 105(*y, m, c, k*) are located at the standby position between the fully abutted position and the monochrome position in the standby state. Therefore, in any one of the cases of switching to the fully abutted position and the monochrome position, the required time becomes shorter than T3, and it is possible to eliminate or shorten the downtime.

(Description of Flow of Execution)

Figure 8:
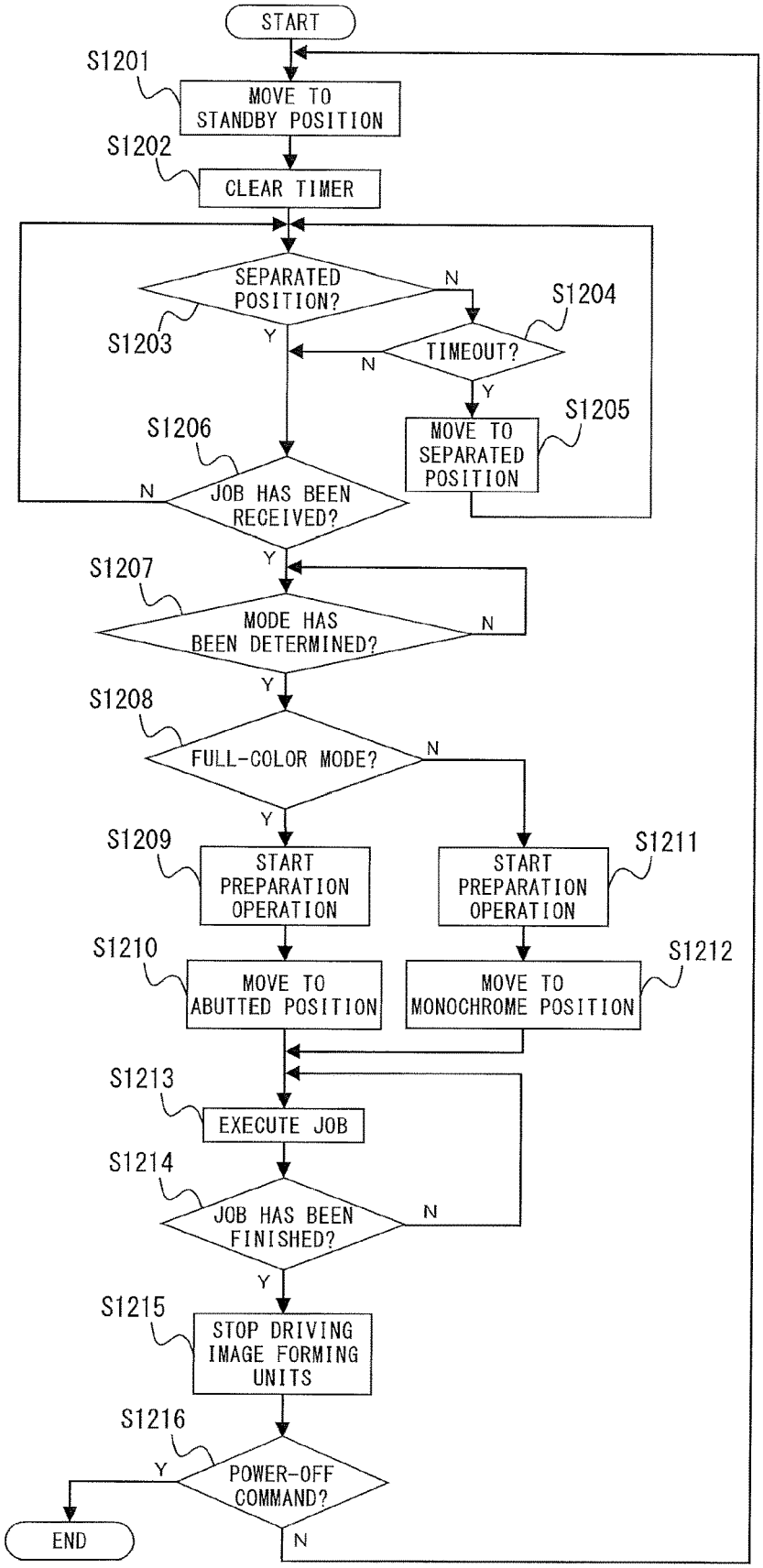
FIG. 8 is a flow chart for illustrating control of the image forming apparatus.

FIG. 8 is an illustration of a flow chart of an image forming method to be executed by the CPU 301 of the controller 100 of the image forming apparatus according to this embodiment. This image forming method is executed by the CPU 301 when the image forming apparatus is powered on or when the image forming apparatus has recovered from a power-saving state. Meanwhile, in this embodiment, the primary transfer rollers 105(*y, m, c, k*) are set at the fully separated position both when the image forming apparatus is powered off and when the image forming apparatus is in a power-saving state.

When the image forming apparatus is powered on (or has recovered from a power-saving state), the CPU 301 moves the positions of the primary transfer rollers 105(*y, m, c, k*) from the fully separated position to the standby position (Step S1201). On this occasion, as described with reference to FIG. 4A to FIG. 6, the CPU 301 drives the abutment/separation motor 504 until the flag 601 reaches the position for blocking the sensor 325.

After the primary transfer rollers 105(*y, m, c, k*) have moved to the standby position, the CPU 301 clears the timer 291 illustrated in FIG. 2 to 0 (Step S1202) to set its value to 0. Then, the timer 291 starts to count time from 0. In this embodiment, the timer 291 constantly adds a timer value every 1 ms, and the CPU 301 acquires the time count of the timer 291, thus to be able to detect a time that has elapsed since a time point at which the timer 291 was cleared to 0. In this embodiment, when a time equal to or larger than a predetermined time has elapsed with the primary transfer rollers 105(*y, m, c, k*) being located at positions other than the fully separated position, the CPU 301 moves the primary transfer rollers 105(*y, m, c, k*) to the fully separated position. The moving is performed in order to limit an amount of coating components of the intermediate transfer belt 130 that are to adhere to the photosensitive drums 101(*y, m, c, k*).

Next, the CPU 301 determines whether or not the primary transfer rollers 105(*y, m, c, k*) are at the fully separated position (Step S1203). When the primary transfer rollers 105(*y, m, c, k*) are not at the fully separated position (N in Step S1203), the CPU 301 determines whether or not a timeout has been achieved, that is, whether or not the timer value is equal to or larger than the value of a timeout tout (Step S1204). When the determination results in N (N in Step S1204), the CPU 301 executes Step S1206 described later. When the determination results in Y (Y in Step S1204), the CPU 301 moves the primary transfer rollers 105(*y, m, c, k*) to the fully separated position (Step S1205), and executes Step S1203 again. In this embodiment, 8 hours is set as the timeout tout to shift to primary-transfer full separation. The value of the timeout tout to shift to the primary-transfer full separation is merely an exemplary value, and any value can be freely set.

When the primary transfer rollers 105(*y, m, c, k*) are at the fully separated position (Y in Step S1203), the CPU 301 determines whether or not the image forming apparatus has received a print job (referred to simply as "job" in FIG. 8) (Step S1206). When a print job has not been received (N in Step S1206), the CPU 301 executes Step S1203 again. When a print job has been received (Y in Step S1206), as described with reference to FIG. 1 and FIG. 2, the CPU 301 determines whether or not the mode has been determined as a result of discrimination of the mode performed by the image signal controller 281 (Step S1207).

When the mode has not been determined (N in Step S1207), the CPU 301 executes Step S1207 again. When the mode has been determined (Y in Step S1207), the CPU 301 determines whether or not the mode is the full-color mode (Step S1208). When the mode is the full-color mode (Y in Step S1208), the CPU 301 starts the preparation operation for the image forming units 120(*y, m, c, k*) (Step S1209). For example, the drum motor y (not shown), the drum motor m (not shown), the drum motor c (not shown), and a drum motor k (not shown) are started to be driven at a target speed for image formation.

When the preparation operation for the image forming units 120(*y, m, c, k*) is started or after the preparation operation is started, the CPU 301 moves the primary transfer rollers 105(*y, m, c, k*) to the fully abutted position corresponding to the full-color mode (Step S1210). After that, the CPU 301 executes Step S1213 described later.

The image forming apparatus according to this embodiment has two modes, namely, the full-color mode and the monochrome mode. Therefore, when it is determined in Step S1208 that the mode is not the full-color mode (N in Step S1208), the CPU 301 determines that the mode is the monochrome mode. After that, the CPU 301 starts the preparation operation for the image forming unit 120*k* (Step S1211), moves the primary transfer rollers 105(*y, m, c, k*) to the monochrome position (Step S1212), and executes Step S1213 described later.

In this manner, after performing the preparation operation for the image forming units 120(*y, m, c, k*) and moving the primary transfer rollers 105(*y, m, c, k*) to the positions corresponding to the mode, the CPU 301 executes the print job to execute the image forming processing (Step S1213). The CPU 301 determines whether or not the print job has been finished (Step S1214), and when the print job has not been finished (N in Step S1214), the CPU 301 executes Step S1213. When the print job has been finished, the CPU 301 stops driving the image forming units 120(*y, m, c, k*) (Step S1215), and determines whether or not a power-off command or a command for a shift to the power-saving mode has been input (Step S1216).

When the command has not been input (N in Step S1216), the CPU 301 executes Step S1201 again. When the command has been input (Y in Step S1216), the CPU 301 moves the primary transfer rollers 105(*y, m, c, k*) to the fully separated position to bring the processing to an end.

As described above, according to this embodiment, during a predetermined period required after the image forming processing is executed until the subsequent image forming processing is executed, the positions of the primary transfer rollers 105(*y, m, c, k*) are set to the standby position. At this standby position, at least a part of the primary transfer rollers 105(*y, m, c, k*) is located between the position in the monochrome mode and the position in the full-color mode.

With this configuration, it is possible to eliminate or shorten the downtime for moving the positions of the primary transfer rollers 105(*y, m, c, k*) to the position corresponding to the print job at the time of the execution of the print job. Accordingly, it is possible to reduce a time required for moving the positions of the primary transfer rollers 105(*y, m, c, k*) to the positions corresponding to the mode before starting the image formation, to be able to shorten a first copy time.

As has been described above, according to this embodiment, it is possible to inhibit an occurrence of the downtime or shorten the downtime even when the position of, for example, the primary transfer roller does not match the mode for performing the image formation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-045231, filed Mar. 13, 2018, which is hereby incorporated by reference herein in its entirety.

What is claimed is:

1. An image forming apparatus, which is operable in an image forming mode in which an image is formed and a standby mode in which an image is not formed, and is operable in a color mode for forming a color image and a monochrome mode for forming a monochrome image when operating in the image forming mode, the image forming apparatus comprising:

a first image bearing member configured to bear a toner image;

a second image bearing member configured to bear a toner image;

a belt member onto which the toner images borne on the first image bearing member and the second image bearing member are to be transferred;

a first transfer member configured to transfer the toner image borne on the first image bearing member onto the belt member;

a second transfer member configured to transfer the toner image borne on the second image bearing member onto the belt member;

a first moving unit configured to move the first transfer member; and a controller configured to control the first moving unit to move the first transfer member such that:

in the monochrome mode, the belt member is located at a first position at which the belt member is separated from the first image bearing member;

in the color mode, the belt member is located at a second position at which the belt member is in contact with the first image bearing member; and in the standby mode, the first transfer member is located at a predetermined position between the first position and the second position, wherein the belt member is in contact with the second image bearing member in the image forming mode and the standby mode.

2. The image forming apparatus according to claim 1, wherein, at the predetermined position, a time required for causing the first transfer member to move from the predetermined position to the second position is a first time and a time required for causing the first transfer member to move from the predetermined position to the first position is a second time, wherein, at the first position, a time required for causing the first transfer member to move from the first position to the second position is a third time, and wherein the first time and the second time are both shorter than the third time.

3. The image forming apparatus according to claim 1, wherein the second transfer member is located at a position at which the belt member is in an abutted state with the second image bearing member in the monochrome mode and the color mode.

4. The image forming apparatus according to claim 1, wherein the controller is configured to control the first moving unit so as to bring the first transfer member to the predetermined position in the standby mode after the image forming apparatus finishes the image formation.

5. The image forming apparatus according to claim 1, further comprising a second moving unit configured to move the second transfer member, wherein the controller is configured to control, in a case in which a predetermined time has elapsed without causing an image to be formed after the first transfer member has moved to the predetermined position in the standby mode, the first moving unit to bring the first transfer member to the second position and the second moving unit to bring the second transfer member to a position at which the belt member is separated from the second image bearing member.

6. The image forming apparatus according to claim 2, wherein the controller is configured to control the first moving unit so as to set at least one of the first time and the second time to become equal to or shorter than a preparation operation period for image formation to be performed by the image forming apparatus.

7. The image forming apparatus according to claim 1, wherein the controller is configured to determine the predetermined position based on an execution frequency of the color mode and an execution frequency of the monochrome mode.

8. The image forming apparatus according to claim 7, wherein the predetermined position is a position at which a time required for causing the first transfer member to move from the predetermined position to the second position is a first time and a time required for causing the first transfer member to move from the predetermined position to the first position is a second time, and wherein the controller is configured to determine, based on the execution frequency of the color mode and the execution frequency of the monochrome mode, whether to control the first moving unit so as to set the first time to become equal to or shorter than a preparation operation period for image formation to be performed by the image forming apparatus or to control the first moving unit so as to set the second time to become equal to or shorter than the preparation operation period for the image formation to be performed by the image forming apparatus.

9. The image forming apparatus according to claim 2, wherein the predetermined position is a position at which the first time and the second time become equal to each other.

10. The image forming apparatus according to claim 9, wherein the second transfer member is in an abutted state with the second image bearing member in the color mode and the monochrome mode.

11. An image formation apparatus, comprising:

a first image bearing member on which a toner image of a first color is to be formed;

a second image bearing member on which a toner image of a second color is to be formed;

a belt member onto which the toner images borne on the first image bearing member and the second image bearing member are to be transferred;

a first transfer member configured to transfer the toner image formed on the first image bearing member onto the belt member;

a second transfer member configured to transfer the toner image formed on the second image bearing member onto the belt member;

a first moving unit configured to move the first transfer member so as to displace the belt member between a contact state, in which the belt member is in contact with the first image bearing member, and a separated state, in which the belt member is separated from the first image bearing member;

a second moving unit configured to move the second transfer member so as to displace the belt member between a contact state, in which the belt member is in contact with the second image bearing member, and a separated state, in which the belt member is separated from the second image bearing member; and a controller configured to:

control, in a monochrome image forming mode for forming the toner image of the second color without forming the toner image of the first color, the first moving unit and the second moving unit such that the belt member is in a separated state from the first image bearing member by a first distance and in a contact state with the second image bearing member;

control, in a color image forming mode for forming the toner image of the first color and the toner image of the second color, the first moving unit and the second moving unit such that the belt member is in a contact state with the first image bearing member and the second image bearing member; and control, in a standby mode for standing by for the image formation to start, the first moving unit and the second moving unit such that the belt member is in a separated state from the first image bearing member by a second distance, which is shorter than the first distance, and in a contact state with the second image bearing member.

12. A method to be executed by an image forming apparatus, the image forming apparatus comprising:

a first image bearing member configured to bear a toner image;

a second image bearing member configured to bear a toner image;

a belt member onto which the toner images borne on the first image bearing member and the second image bearing member are to be transferred;

a first transfer member configured to transfer the toner image borne on the first image bearing member onto the belt member;

a second transfer member configured to transfer the toner image borne on the second image bearing member onto the belt member;

a first moving unit configured to move the first transfer member;

the first image bearing member and the second image bearing member capable of being abutted against the first transfer member and the second transfer member, respectively, through intermediation of the belt member, to thereby transfer the respective toner images onto the belt member, the image forming apparatus being operable in an image forming mode in which an image is formed and a standby mode in which an image is not formed, and further being operable in a color mode for forming a color image and a monochrome mode for forming a monochrome image when operating in the image forming mode, wherein the method comprises:

controlling the first moving unit to move the first transfer member such that:

in the monochrome mode, the belt member is located at a first position at which the belt member is separated from the first image bearing member;

in the color mode, the belt member is located at a second position at which the belt member is in contact with the first image bearing member; and in the standby mode, the first transfer member is located at a predetermined position between the first position and the second position, and wherein the belt member is in contact with the second image bearing member in the image forming mode and the standby mode.

13. A method to be executed by an image forming apparatus, the image forming apparatus comprising:

a first image bearing member on which a toner image of a first color is to be formed;

a second image bearing member on which a toner image of a second color is to be formed;

a belt member onto which the toner images borne on the first image bearing member and the second image bearing member are to be transferred;

a first transfer member configured to transfer the toner image formed on the first image bearing member onto the belt member;

a second transfer member configured to transfer the toner image formed on the second image bearing member onto the belt member;

a first moving unit configured to move the first transfer member so as to displace the belt member between a contact state, in which the belt member is in contact with the first image bearing member, and a separated state, in which the belt member is separated from the first image bearing member; and a second moving unit configured to move the second transfer member so as to displace the belt member between a contact state, in which the belt member is in contact with the second image bearing member, and a separated state, in which the belt member is separated from the second image bearing member;

wherein the method comprises:

controlling the first moving unit to move the first transfer member and controlling the second moving unit to move the second transfer member such that:

in a monochrome image forming mode for forming the toner image of the second color without forming the toner image of the first color, the first moving unit and the second moving unit are controlled such that the belt member is in a separated state from the first image bearing member by a first distance and in a contact state with the second image bearing member;

in a color image forming mode for forming the toner image of the first color and the toner image of the second color, the first moving unit and the second moving unit are controlled such that the belt member is in a contact state with the first image bearing member and the second image bearing member; and in a standby mode for standing by for the image formation to start, the first moving unit and the second moving unit are controlled such that the belt member is in a separated state from the first image bearing member by a second distance, which is shorter than the first distance, and in a contact state with the second image bearing member.

* * * * *